US010094248B2

(12) United States Patent
Gudaloor et al.

(10) Patent No.: US 10,094,248 B2
(45) Date of Patent: Oct. 9, 2018

(54) LASH ADJUSTER AND METHOD OF MAKING SAME

(71) Applicant: Eaton Corporation, Cleveland, MI (US)

(72) Inventors: Prasanna Kumar Gudaloor, Portage, MI (US); John Page Chapman, Richland, MI (US); Gary Lynn Janowiak, Saginaw, MI (US)

(73) Assignee: Eaton Corporation, Cleveland, OH (US)

( * ) Notice: Subject to any disclaimer, the term of this patent is extended or adjusted under 35 U.S.C. 154(b) by 94 days.

(21) Appl. No.: 15/058,689

(22) Filed: Mar. 2, 2016

(65) Prior Publication Data

US 2016/0177790 A1 Jun. 23, 2016

Related U.S. Application Data

(63) Continuation of application No. PCT/US2014/057760, filed on Sep. 26, 2014.
(Continued)

(51) Int. Cl.
*F01L 1/24* (2006.01)
*F01L 1/20* (2006.01)
(Continued)

(52) U.S. Cl.
CPC ..... *F01L 1/20* (2013.01); *F01L 1/2405* (2013.01); *B21K 1/20* (2013.01); *B22F 3/10* (2013.01);
(Continued)

(58) Field of Classification Search
CPC ..... F01L 1/24; F01L 1/2405; F01L 1/2411; F01L 1/2416; F01L 1/2422; F01L 2001/2427; F01L 1/46
(Continued)

(56) References Cited

U.S. PATENT DOCUMENTS 2,932,290 A 4/1960 Christensen
3,291,107 A 12/1966 Cornell
(Continued)

FOREIGN PATENT DOCUMENTS

JP 60209609 A 10/1985
JP 2003222007 8/2003
JP 2009236037 10/2009

OTHER PUBLICATIONS

Supplementary European Search Report for EP Application No. 14 84 9857 dated Mar. 10, 2017.
(Continued)

*Primary Examiner* — Jorge Leon, Jr.
(74) *Attorney, Agent, or Firm* — RMCK Law Group PLC

(57) ABSTRACT

A method of manufacturing a lash adjuster body for use in a lash adjuster assembly can include forming a lash adjuster body to an as-formed condition including an outer cylindrical surface and an inner cylindrical surface. The inner cylindrical surface can have a leak down portion and a blind bore. The method can also include imparting a wear resistant surface layer to at least the leak down portion of the inner cylindrical surface with a sub-critical temperature process. The method can also include preserving the leak down portion in the as-formed condition during imparting of the wear resistant surface layer.

20 Claims, 5 Drawing Sheets

Related U.S. Application Data

(60) Provisional application No. 61/883,625, filed on Sep. 27, 2013, provisional application No. 62/056,049, filed on Sep. 26, 2014.

(51) Int. Cl.

| | |
|---|---|
| *F01L 1/46* | (2006.01) |
| *B21K 1/20* | (2006.01) |
| *B22F 3/10* | (2006.01) |
| *B22F 3/22* | (2006.01) |
| *B22F 5/10* | (2006.01) |

(52) U.S. Cl.
CPC ..... *B22F 3/225* (2013.01); *B22F 5/10* (2013.01); *F01L 1/46* (2013.01)

(58) Field of Classification Search
USPC ..... 123/90.43, 90.45, 90.46, 90.52
See application file for complete search history.

(56) References Cited

U.S. PATENT DOCUMENTS

| | | | | |
|---|---|---|---|---|
| 4,184,464 | A * | 1/1980 | Svihlik | F01L 1/2405 123/90.55 |
| 5,901,676 | A * | 5/1999 | Edelmayer | F01L 1/2405 123/90.35 |
| 7,293,540 | B2 * | 11/2007 | Mandal | F01L 1/146 123/90.16 |
| 2002/0069939 | A1 | 6/2002 | Ahn | |
| 2006/0049035 | A1 * | 3/2006 | Hosenfeldt | C23C 14/024 204/192.15 |

OTHER PUBLICATIONS

International Search Report and Written Opinion for International Application No. PCT/US2014/057760 dated Jan. 8, 2015, 14 pages.

* cited by examiner

LASH ADJUSTER AND METHOD OF MAKING SAME

CROSS-REFERENCE TO RELATED APPLICATIONS

This application is a continuation of International Application No. PCT/US2014/057760 filed Sep. 26, 2014, which claims the benefit of U.S. Patent Application No. 61/883,625 filed on Sep. 27, 2013 and U.S. Patent Application No. 62/056,049 filed on Sep. 26, 2014. The disclosures of the above applications are incorporated herein by reference.

FIELD

The present disclosure is directed to a hydraulic or mechanical lash adjuster and a method of manufacturing the same.

BACKGROUND

Hydraulic or mechanical lash adjusters for internal combustion engines have been in use for many years to eliminate clearance or lash between engine valve train components under varying operating conditions. Lash adjusters can maintain efficiency and reduce noise and wear in the valve train. In some examples, hydraulic lash adjusters can support the transfer of energy from the valve-actuating cam to the valves through hydraulic fluid trapped in a pressure chamber under the plunger.

The background description provided herein is for the purpose of generally presenting the context of the disclosure. Work of the presently named Inventors, to the extent it is described in this background section, as well as aspects of the description that may not otherwise qualify as prior art at the time of filing, are neither expressly nor impliedly admitted as prior art against the present disclosure.

SUMMARY

A method of manufacturing a lash adjuster body for use in a lash adjuster assembly can include forming a lash adjuster body to an as-formed condition including an outer cylindrical surface and an inner cylindrical surface. The inner cylindrical surface can have a leak down portion and a blind bore. The method can also include imparting a wear resistant surface layer to at least the leak down portion of the inner cylindrical surface with a sub-critical temperature process. The method can also include preserving the leak down portion in the as-formed condition during imparting of the wear resistant surface layer.

According to additional features, forming can be further defined as forming a lash adjuster body with one of cold forming, stamping, drawing, metal injection molding, powdered metal sintering, and machining. Forming can be further defined as cold-forming the lash adjuster body to the as-formed condition having functional geometry. The preserving can then be further defined as preserving the functional geometry of the leak down portion in the as-formed condition during imparting of the wear resistant surface layer. The preserving can be further defined as preserving the functional geometry of the leak down portion in the as-formed condition after imparting of the wear resistant surface layer.

According to other features, imparting can be further defined as imparting a wear resistant surface layer to at least the leak down portion of the inner cylindrical surface with a sub-critical temperature process selected from one of ferritic nitrocarburizing, physical vapor deposition, and chemical vapor deposition. The method can also include maintaining a hardness of the lash adjuster body below the wear resistant surface layer after forming and during imparting. Preserving can further comprise preserving the leak down portion of the inner cylindrical surface in the as-formed condition after imparting of the wear resistant surface layer. Preserving can further comprise preserving a majority of the inner cylindrical surface in the as-formed condition after imparting of the wear resistant surface layer. Preserving can further comprise preserving a majority of the outer cylindrical surface in the as-formed condition after imparting of the wear resistant surface layer. Preserving can further comprise preserving a majority of both of the outer cylindrical surface and the inner cylindrical surface in the as-formed condition after imparting of the wear resistant surface layer.

In other features, the method can also include annealing the lash adjuster body before imparting to relieve stresses arising during forming. The method can also include cleaning the lash adjuster body after imparting and polishing the lash adjuster body after imparting.

A lash adjuster body for use in a lash adjuster assembly can include an outer cylindrical surface and an inner cylindrical surface. The inner cylindrical surface can have a leak down portion and a blind bore. At least the leak down portion of the inner cylindrical surface can include a wear resistant surface layer imparted with a sub-critical temperature process. The leak down portion can be preserved in an as-formed condition existing prior to the imparting of the wear resistant surface layer.

According to additional features, the majority of the at least one of the outer cylindrical surface and the inner cylindrical surface can be modified through the sub-critical temperature process being one of ferritic nitrocarburizing, physical vapor deposition, and chemical vapor deposition. The inner cylindrical surface can further comprise a plunger shelf and a notch. The notch can be positioned between the leak down portion and the plunger shelf.

A lash adjuster assembly can include a lash adjuster body and a leak down plunger. The lash adjuster body can include an outer cylindrical surface and an inner cylindrical surface. The inner cylindrical surface can include a leak down portion and a blind bore. At least the leak down portion of the inner cylindrical surface can include a wear resistant surface layer imparted with a sub-critical temperature process. The leak down portion can be preserved in an as-formed condition existing prior to the imparting of the wear resistant surface layer. The leak down plunger can be slidably received in the inner cylindrical surface against the leak down portion.

According to additional features, a majority of the outer cylindrical surface and a majority of the inner cylindrical surface include the wear resistant surface layer. The majorities of the outer and inner cylindrical surfaces can be preserved in the as-formed condition existing prior to the imparting of the wear resistant surface layer. A majority of the inner cylindrical surface can include the wear resistant surface layer and a functional geometry of the majority of the inner cylindrical surface can be maintained in the as-formed condition existing prior to the imparting of the wear resistant surface layer. The wear resistant surface layer can have a depth of less than forty microns.

BRIEF DESCRIPTION OF THE DRAWINGS

The present disclosure will become more fully understood from the detailed description and the accompanying drawings, wherein.

DETAILED DESCRIPTION

Figure 1:
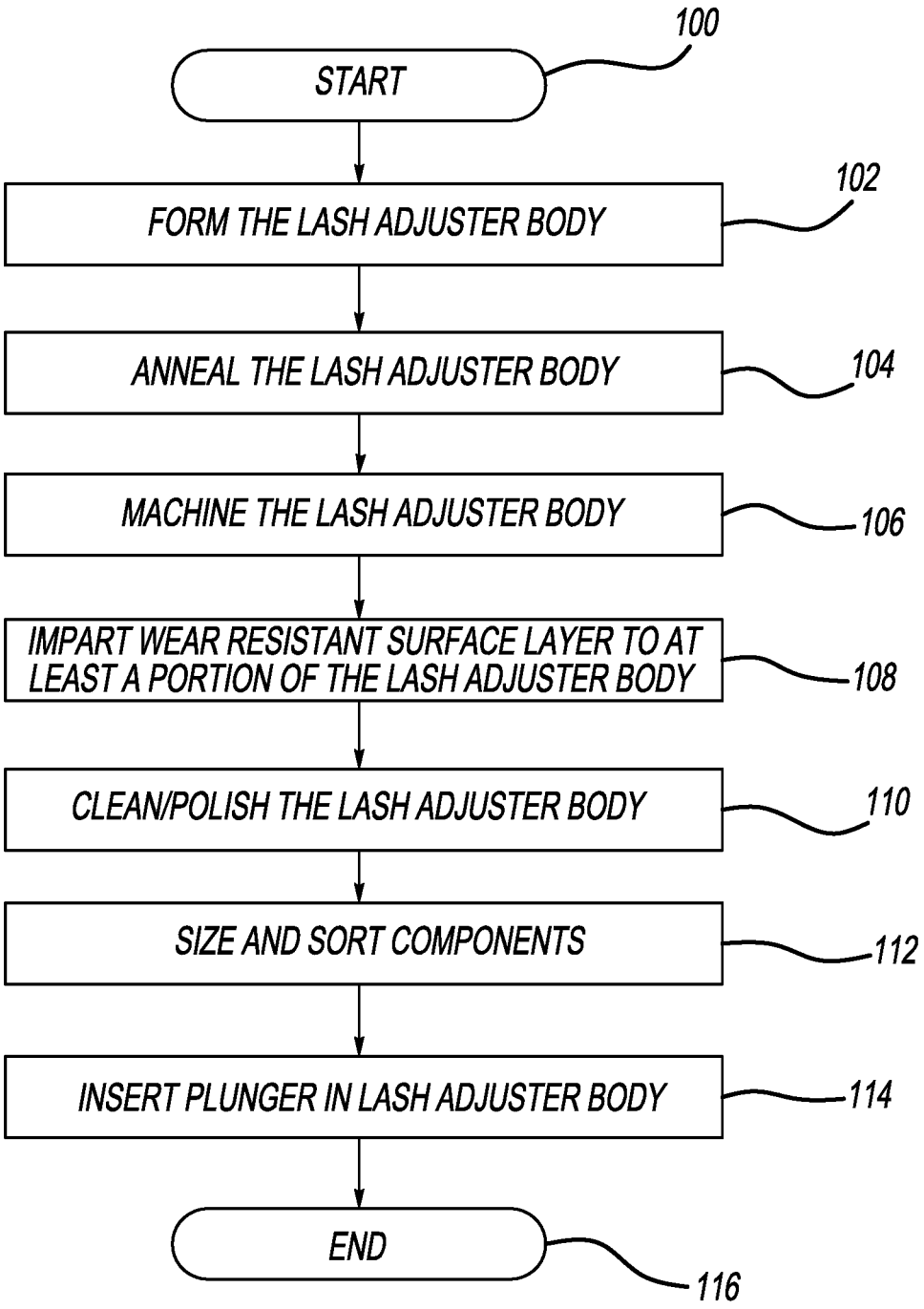
FIG. 1 is flow chart of a process in accordance with an example of the present disclosure.

A plurality of different embodiments of the present disclosure is shown in the Figures of the application. Similar features are shown in the various embodiments of the present disclosure. Similar features have been numbered with a common reference numeral and have been differentiated by an alphabetic suffix. Similar features across different embodiments have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

With reference now to FIG. 1, a method of manufacturing a lash adjuster body for use in a lash adjuster assembly can start at 100. At 102, a lash adjuster body can be formed to an as-formed condition. The as-formed condition can be defined as the lash adjuster body having functional geometry at the completion of 102. Functional geometry refers to the fact the lash adjuster body can be operable to perform upon being formed without further processing that would alter the geometry of the lash adjuster body.

Figure 2:
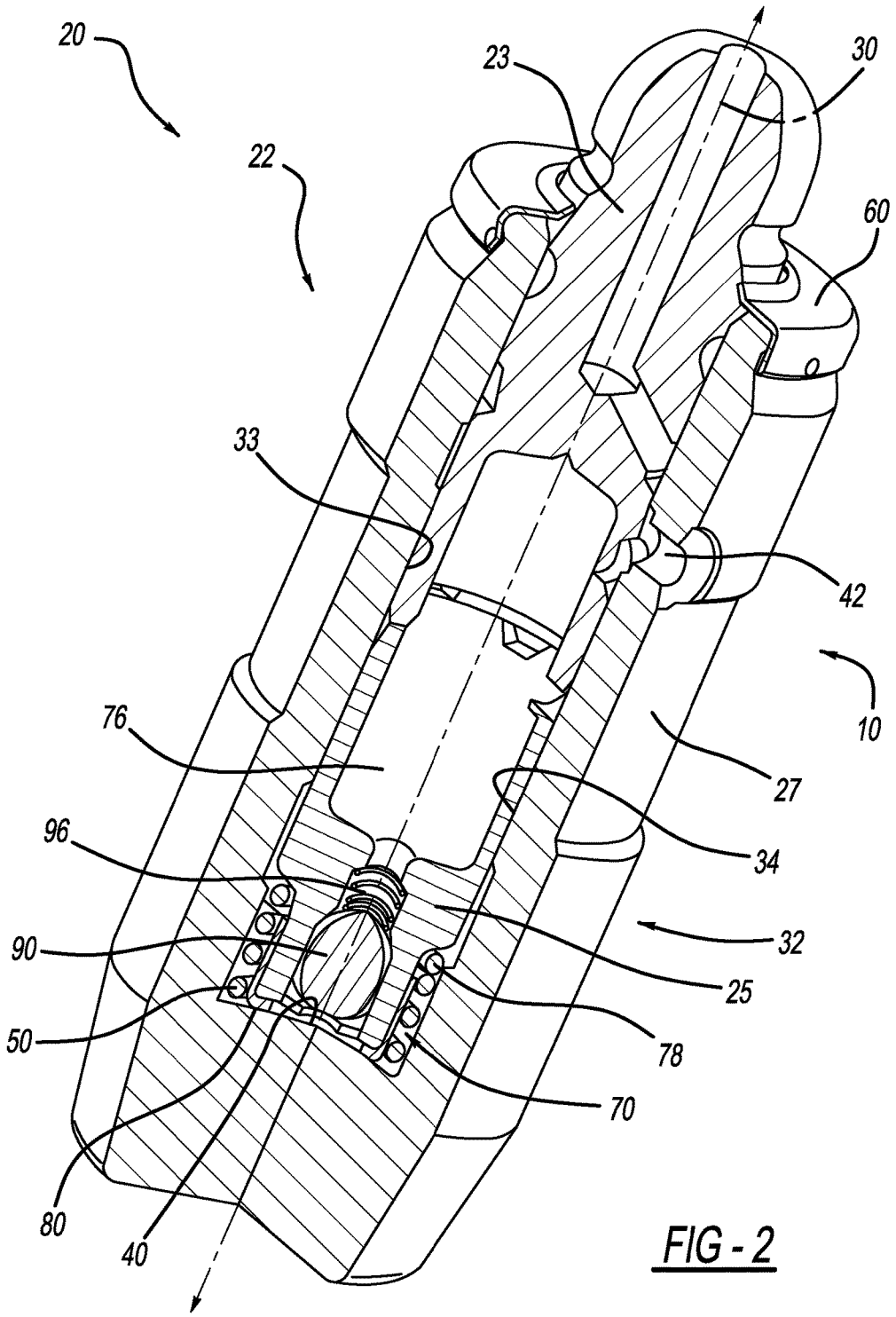
FIG. 2 is a cross-sectional view of a normally open lash adjuster constructed in accordance with another example of the present disclosure.

An exemplary lash adjuster body is referenced at 20 in FIG. 2. The lash adjuster body 20 can be formed using established metal forming and/or machining techniques with or without thermal input. Such technique could include cold-forming or cold-forging or cold-heading, deep-drawing cold formed in one or more embodiments of the present disclosure. Cold forming can be a relatively high-speed manufacturing process whereby metal is shaped at relatively lower temperatures. A cold-formed workpiece is not necessarily heated, but can increase in temperature during the cold forming process. Cold forming can be carried out without removing material from a workpiece. Metal can be forced beyond the elastic yield limit but below tensile strength. As used herein, the term "cold-forming" and its derivatives, are intended to encompass what is known in the art as "cold-forging", "cold heading" and "deep drawing". The lash adjuster body blank can be precision cold formed, wherein workpiece dimensions can be held to within microns. In some other embodiments, the lash adjuster body blank can be formed with stamping, drawing, metal injection molding, powdered metal sintering, or machining.

With reference now to FIG. 2, the lash adjuster body 20 can have an outer cylindrical surface 32 and an inner cylindrical surface 33. The inner cylindrical surface 33 can include a leak down portion 34 and a blind bore 40. The lash adjuster body 20 can be manufactured such that a majority of at least one of the outer cylindrical surface 32 and the inner cylindrical surface 33 is maintained in an as-formed condition. An unground condition can define one example of an as-formed condition. For example only, neither of the surfaces 32, 34 may be subjected to grinding in one or more embodiments of the present disclosure. Generally, grinding and machining are distinct subsets of metal removal generally. Grinding is a microscopic cutting operation and machining is a macroscopic cutting operation. Alternatively, at least one of the surfaces 32, 34 is not subjected to grinding in one or more embodiments of the present disclosure. Generally, if it is desired to grind the inner cylindrical surface 33, the outer cylindrical surface 32 must be ground as well since the lash adjuster body 20 will be held by the outer cylindrical surface 32 during grinding of the inner cylindrical surface 33. The exemplary lash adjuster body 20 of the present disclosure is thus not over-processed.

Referring again to FIG. 1, the lash adjuster body can be annealed at 104 in one or more embodiments of the present disclosure to reduce residual stresses. Processes for relieving stress alternative to annealing can be applied in some embodiments of the present disclosure. At 106, material can be machined from the lash adjuster body. A lash adjuster body can be machined by defining an aperture or by turning a groove in the outer cylindrical surface of the lash adjuster body, and by metal removal to qualify over-all length. As used herein, the term "machining" can mean the use of a chucking machine, drilling machine, turning machine, or broaching machine to remove material.

At 108, a wear resistant surface layer can be imparted to at least a portion of the lash adjuster body. The wear resistance of the portion of the lash adjuster body can be enhanced by 108. The wear resistant surface layer can be imparted to the outer cylindrical surface 32 and the inner cylindrical surface 33 in one or more embodiments of the present disclosure. Alternatively, the outer cylindrical surface 32 may or may not be imparted with a wear resistant surface layer. Any sub-critical temperature process can be applied to impart the wear resistant surface layer, such as by way of example and not limited to ferritic nitrocarburizing (hereafter "FNC"), physical vapor deposition (hereafter "PVD"), or chemical vapor deposition (hereafter "CVD"). Other sub-critical temperature process can be applied as well. FNC is a thermochemical surface hardening process that includes diffusion of nitrogen and carbon onto the lash adjuster body. PVD is a process in which a solid coating material is evaporated by heat or by bombardment with ions on a workpiece to be coated. CVD is a process in which a workpiece is exposed to one or more volatile precursors which react and/or decompose on the workpiece to produce the desired coating. Such processes for imparting a wear resistant surface layer may be employed with or without a vacuum process to minimize or eliminate distortion.

It is noted that the order of 106 and 108 can be reversed in some embodiments of the present disclosure. In such an embodiment, the machining can include producing a side hole on the body, such as aperture 42. Alternatively, the machining could include creating an outer diameter groove such as groove 27. Alternatively, the machining could include creating the geometry for a hook portion such as hook portion 98*b* shown in FIG. 4. The machining operation could remove a portion of the wear resistant surface layer that was previously imparted to the lash adjuster body 20. Machining can also include material removal to correct the overall length of the lash adjuster body 20 and include lead-in angles or chamfers and/or radii on the inner and outer cylindrical surfaces.

According to prior art methods, the lash adjuster body would undergo a heat treatment process such as carbonitriding. Carbonitriding is a metallurgical surface modification technique that is used to increase surface hardness of a metal. Heat-treating the lash adjuster body with a process such as carbonitriding can cause the geometry of the lash adjuster body to be distorted. In such scenarios, a subsequent machining or grinding or material working step is necessary to return the lash adjuster body to its "pre-heat treated" shape or to an otherwise desired resultant shape. In the embodiments of the present disclosure, a conventional heat treatment step is replaced by incorporating a subcritical temperature process such as FNC or PVD or CVD that imparts a wear resistant surface layer and helps preserve the functional geometry of the lash adjuster body requiring no additional operations to correct distortion. Similar to increasing hardness as provided by carbonitriding, FNC enhances the wear resistance of a surface. In this regard, substantial time and cost savings may be realized by manufacturing the lash adjuster body according to the present method.

The functional geometry of the lash adjuster body is preserved as the wear resistant surface is being imparted. The lash adjuster body can thus be functionally operable after the imparting of the wear resistant surface. The wear resistant surface layer can have a depth of less than forty microns in some embodiments of the present disclosure. The wear resistant surface layer can have a depth of less than thirty microns in some embodiments of the present disclosure. The wear resistant surface layer can have a depth of less than twenty microns in some embodiments of the present disclosure. The wear resistant surface layer can have a depth of between ten and twenty microns in some embodiments of the present disclosure. The wear resistant surface layer can have a depth of between one and ten microns in some embodiments of the present disclosure.

At 110, the lash adjuster body can be subjected to cleaning and/or polishing. Cleaning and polishing could be carried out concurrently or sequentially. Any mechanical methods can be applied to re-establish the surface finish after a wear resistant surface layer is imparted. A plurality of lash adjuster bodies can be cleaned and polished at one time.

At 112, the lash adjuster body can be sized and sorted. The method discussed above can produce more repeatable lash adjuster bodies thereby reducing categories for size and sort operations. Explained further, because (i) the conventional heat treating step that can alter the geometry of the lash adjuster body and (ii) the subsequent machining (such as grinding) step that can further alter the geometry of the lash adjuster body are both eliminated, together less opportunities for the shape of the lash adjuster body to be distorted are presented. The geometries of the lash adjuster bodies are therefore more consistent. Inventory can be reduced. Capital cost can also be significantly reduced for processing the components.

Referring again to FIG. 2, a lash adjuster assembly constructed in accordance to one example of the present disclosure is shown and generally identified at reference number 10. The lash adjuster assembly 10 is of the Type 2 valve train variety. It will be appreciated, however, that the teachings discussed herein with regard to the lash adjuster assembly 10 can be used in any configuration of lash adjuster and is not limited to the configuration shown in FIG. 2. The lash adjuster assembly 10 can generally include a lash adjuster body 20 and a leak down and ball plunger combination 22. The leak down and ball plunger combination 22 can include a ball plunger 23 and a leak down plunger 25. The discussion above that focused on a method of forming the lash adjuster body 20 may also be applicable to other components of the lash adjuster assembly 10 including, but not limited to, the ball plunger 23 and/or the leak down plunger 25 of the leak down and ball plunger combination 22.

The lash adjuster body 20 can generally extend along a longitudinal body axis 30 and includes the outer cylindrical surface 32 and the inner cylindrical surface 33. The inner cylindrical surface 33 can define the blind bore 40. A fluid aperture 42 can be defined through the lash adjuster body 20.

The lash adjuster body 20 can be assembled with the remaining components of a lash adjuster assembly 10. The components can then be provided into a final lash adjuster assembly. Referring again to FIG. 2, the leak down plunger 25 and the ball plunger 23 can be inserted in the lash adjuster body 20 at 114. As shown in FIG. 2, the leak down plunger 25 can be received in the inner cylindrical surface 33 of the lash adjuster body 20. All or the majority of the inner cylindrical surface 33 can be preserved in an as-formed condition and the leak down plunger 25 can be slidably engaged with the majority of the inner cylindrical surface 33 during insertion. After assembly and in operation, the leak down plunger 25 can be slidably engaged with the leak down portion 34 of the inner cylindrical surface 33. In the exemplary lash adjuster body 20, the majority of the outer cylindrical surface 32 can also be preserved in an as-formed condition. The exemplary process can end at 116 in FIG. 1.

Referring again to FIG. 2, the leak down plunger 25 can be configured for reciprocal movement relative to the lash adjuster body 20 along the longitudinal body axis 30. This movement can be sliding movement of the outside surface of the leak down plunger 25 against the leak down portion 34 of the inner cylindrical surface 33. A plunger spring 50 can be disposed within the blind bore 40 underneath the leak down plunger 25 and be configured to bias the leak down plunger 25 in an upward direction (as viewed in FIG. 2) relative to the lash adjuster body 20. The plunger spring 50 can act at all times to elevate the leak down plunger 25 to maintain its engagement with the hemispherical concave surface (not shown) of a rocker arm (not shown). In the example shown, a retaining member 60 is provided adjacent an upper portion of the lash adjuster body 20. The retaining member 60 limits upward movement of the leak down plunger 25 relative to the lash adjuster body 20 and retains the leak down plunger 25 within the lash adjuster body 20.

The lash adjuster assembly 10 includes a check valve assembly 70 positioned between the plunger spring 50 and the leak down plunger 25 of the leak down and ball plunger combination 22. The check valve assembly 70 functions to either permit fluid communication or block fluid communication between a low-pressure fluid chamber 76 and a high-pressure fluid chamber 78 in response to pressure differential between the two fluid chambers 76 and 78. The check valve assembly 70 can include a retainer 80 that is in engagement with the leak down plunger 25 of the leak down and ball plunger combination 22, a check ball 90, and a check ball spring 96 that is disposed between the leak down plunger 25 and the check ball 90. The check ball spring 96 can be configured to bias the check ball 90 in a downward direction (as viewed in FIG. 2). The check valve assembly 70 can be referred to by those skilled in the art as "normally open."

Figure 3:
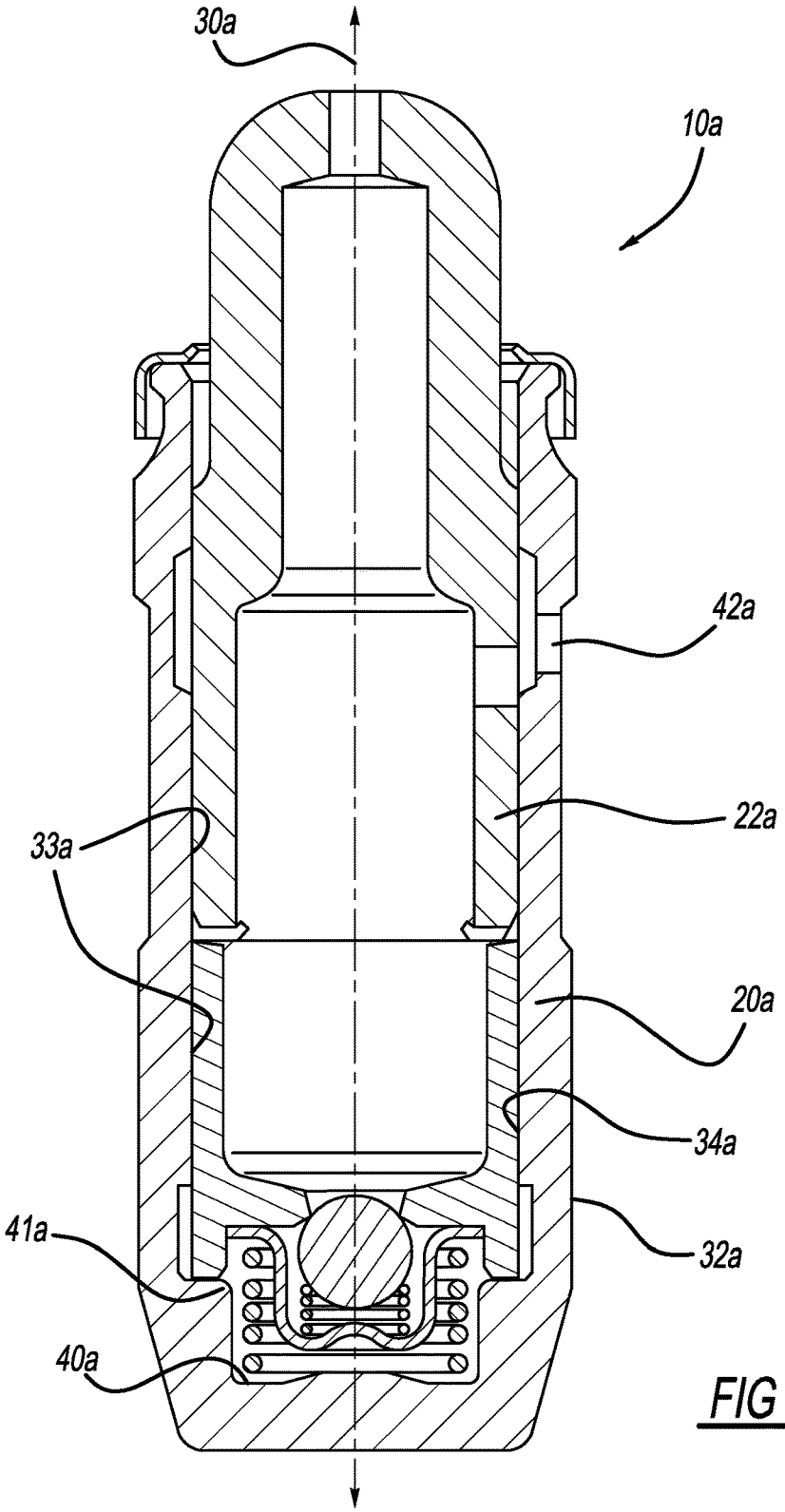
FIG. 3 is a cross-sectional view of a normally closed lash adjuster constructed in accordance with another example of the present disclosure.

With reference now to FIG. 3, a lash adjuster assembly constructed in accordance with another example of the present disclosure is shown and generally identified at reference number 10*a*. The lash adjuster assembly 10*a* can extend along an axis 30*a* and generally include a lash adjuster body 20*a* and a leak down and ball plunger combination 22*a*. An aperture 42*a* can be defined in the lash adjuster body 20*a*. The lash adjuster assembly 10*a* can comprise similar components as described above, but be configured as a normally closed lash adjuster. The lash adjuster body 20*a* can have an outer cylindrical surface 32*a* and an inner cylindrical surface 33*a*. The inner cylindrical surface 33*a* can include a leak down portion 34*a*, a blind bore 40*a*, and a plunger shelf 41*a*. The lash adjuster body 20*a* can be formed using the techniques described above. Specifically, the lash adjuster body 20*a* can be constructed using the method described above that avoids a heat treatment step and alternatively incorporates a process that imparts a wear resistant surface layer such as FNC, PVD, or CVD.

Figure 4:
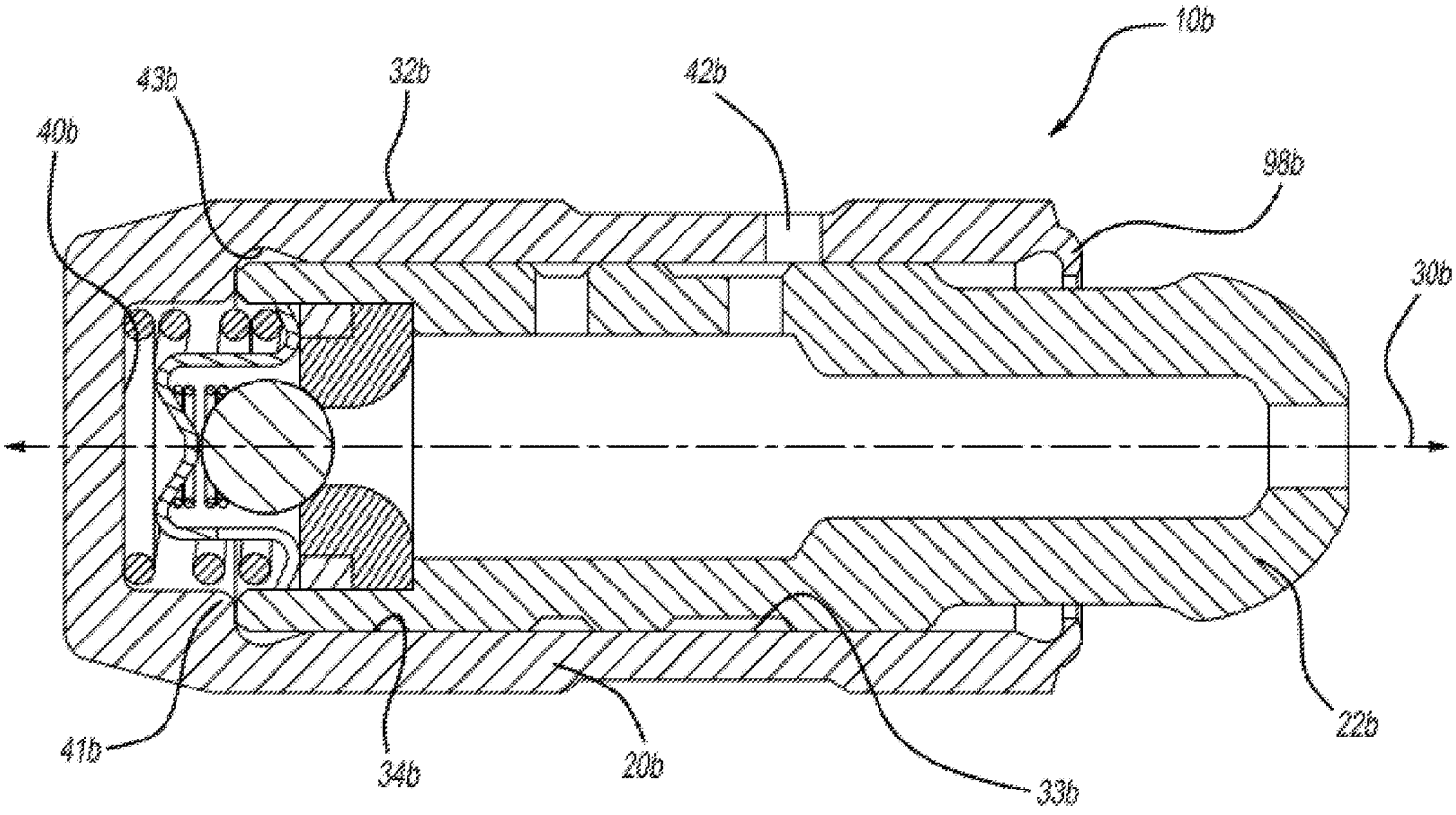
FIG. 4 is a cross-sectional view of a normally closed lash adjuster constructed in accordance with another example of the present disclosure.

FIG. 4 discloses another embodiment of the present disclosure. A lash adjuster assembly constructed in accordance with another example of the present disclosure is shown and generally identified at reference number 10*b*. The lash adjuster assembly 10*b* can extend along an axis 30*b* and generally include a lash adjuster body 20*b* and a leak down and ball plunger combination 22*b*. The lash adjuster body 20*b* can have an outer cylindrical surface 32*b* and an inner cylindrical surface 33*b*. The inner cylindrical surface 33*b* can include a leak down portion 34*b*, a blind bore 40*b*, and a plunger shelf 41*b*. The inner cylindrical surface 33*b* can further comprise a notch 43*b*. The notch 43*b* can be semi-obovate in cross-section and be positioned between the leak down portion 34*b* and the plunger shelf 41*b*. Notches of other shapes can be applied in other embodiments of the present disclosure. An aperture 42*b* can be defined in the lash adjuster body 20*b*. The lash adjuster assembly 10*b* can comprise similar components as described above, but be configured as a normally closed lash adjuster. The lash adjuster body 20*b* can be formed using the techniques described above. Specifically, the lash adjuster body 20*b* can be constructed using the method described above that avoids a heat treatment step and alternatively incorporates a sub-critical temperature process that imparts a wear resistant surface layer such as FNC, PVD, or CVD.

The lash adjuster body 20*b* can define an inner diameter relief or hook portion 98*b*. The hook portion 98*b* can be created in the lash adjuster body 20*b* after a wear resistant surface layer is imparted. The wear resistant surface layer on the inside and/or outside of the hook portion 98*b* can be removed prior to crimping of the hook portion 98*b* to prevent fracture or breakage. The hook portion 98*b* can be crimped or deformed to provide retention of the leak down and ball plunger combination 22*b* within the lash adjuster assembly 10*b* and can eliminate the need for bottle-caps, wires and clips to retain the leak down and ball plunger combination 22*b*. Alternatively, the hook portion 98*b* of the body 20*b*, that is used for retention of the leak down and ball plunger combination 22*b*, can be used with conventional heat treatment of the lash adjuster body. In such application, the case or hard outer layers can be removed before crimping to prevent cracking or fracturing.

Figure 5:
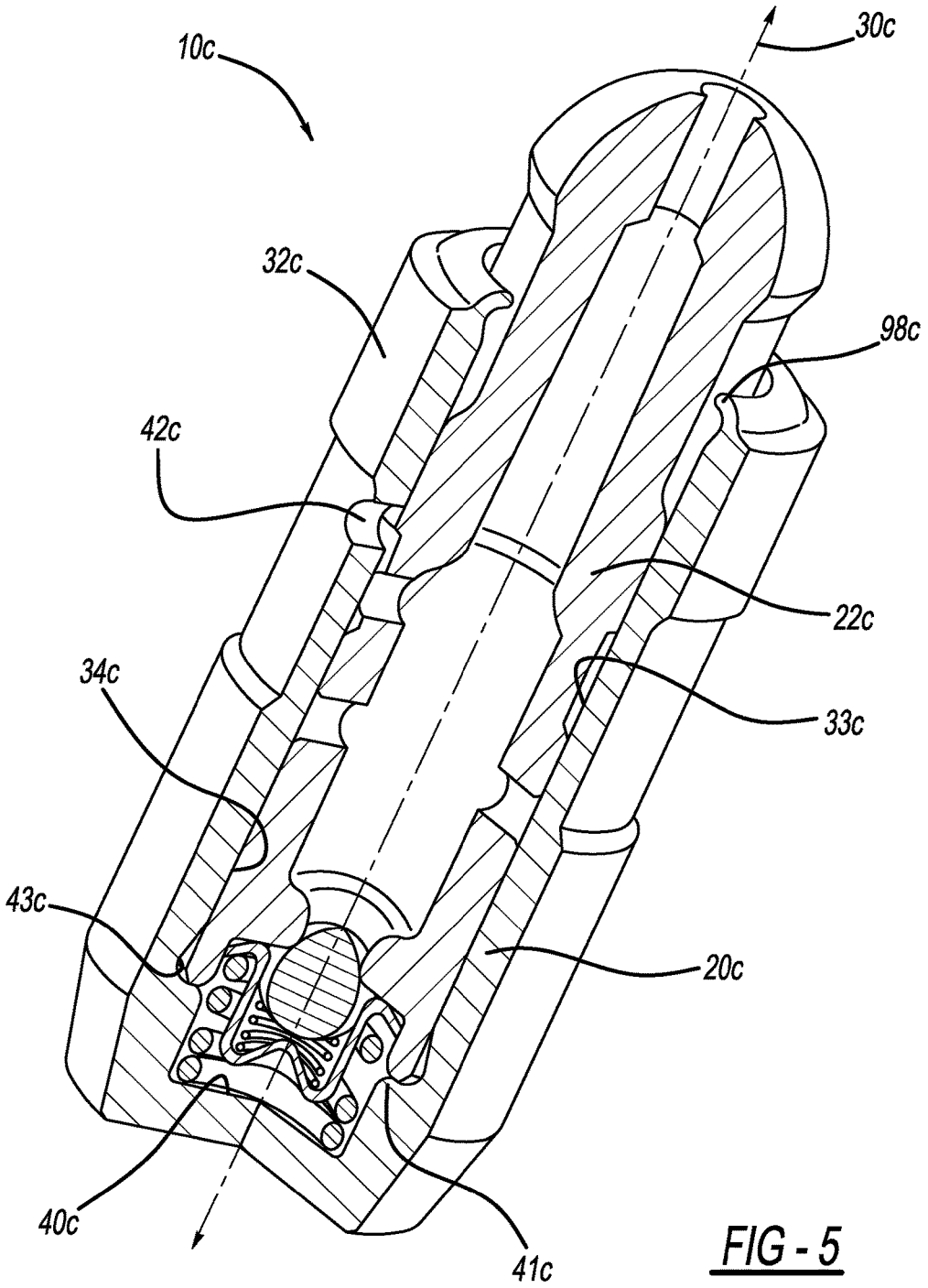
FIG. 5 is a variant cross-sectional view of a normally closed lash adjuster constructed in accordance with another example of the present disclosure.

FIG. 5 discloses another embodiment of the present disclosure, a variant of the embodiment shown in FIG. 4. A lash adjuster assembly constructed in accordance with another example of the present disclosure is shown and generally identified at reference number 10*c*. The lash adjuster assembly 10*c* can extend along an axis 30*c* and generally include a lash adjuster body 20*c* and a leak down and ball plunger combination 22*c*. The lash adjuster body 20*c* can have an outer cylindrical surface 32*c* and an inner cylindrical surface 33*c*. The inner cylindrical surface 33*c* can include a leak down portion 34*c*, a blind bore 40*c*, and a plunger shelf 41*c*. The inner cylindrical surface 33*c* can further comprise a notch 43*c*. The notch 43*c* can be semi-obovate in cross-section and be positioned between the leak down portion 34*c* and the plunger shelf 41*c*. Notches of other shapes can be applied in other embodiments of the present disclosure. An aperture 42*c* can be defined in the lash adjuster body 20*c*. The lash adjuster assembly 10*c* can comprise similar components as described above, but be configured as a normally closed lash adjuster. The lash adjuster body 20*c* can be formed using the techniques described above. Specifically, the lash adjuster body 20*c* can be constructed using the method described above that avoids a heat treatment step and alternatively incorporates a sub-critical temperature process that imparts a wear resistant surface layer such as FNC, PVD, or CVD. The lash adjuster body 20*c* can define an inner diameter relief or hook portion 98*c*. The hook portion 98*c* can be created in the lash adjuster body 20*c* after a wear resistant surface layer is imparted.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of manufacturing a lash adjuster body for use in a lash adjuster assembly, the method comprising:

forming a lash adjuster body to an as-formed condition including an outer cylindrical surface and an inner cylindrical surface having a leak down portion and a blind bore;

annealing the lash adjuster body to relieve stresses arising during forming;

subsequent to the annealing, imparting a wear resistant outermost surface layer to at least the leak down portion of the inner cylindrical surface with a sub-critical temperature process using ferritic nitrocarburizing (FNC); and preserving the leak down portion in the as-formed condition during imparting of the wear resistant surface layer.

2. The method of claim 1 wherein forming is further defined as:

forming a lash adjuster body with one of cold forming, stamping, drawing, metal injection molding, powdered metal sintering, and machining.

3. The method of claim 1 wherein forming is further defined as:

cold-forming the lash adjuster body to the as-formed condition having functional geometry.

4. The method of claim 3 wherein preserving is further defined as:

preserving a functional geometry of the leak down portion in the as-formed condition during imparting of the wear resistant surface layer.

5. The method of claim 4 wherein preserving is further defined as:

preserving the functional geometry of the leak down portion in the as-formed condition after imparting of the wear resistant surface layer.

6. The method of claim 1 further comprising:

maintaining a hardness of the lash adjuster body below the wear resistant surface layer after forming and during imparting.

7. The method of claim 1 wherein preserving further comprises:

preserving the leak down portion of the inner cylindrical surface in the as-formed condition after imparting of the wear resistant surface layer.

8. The method of claim 1 wherein preserving further comprises:

preserving a majority of the inner cylindrical surface in the as-formed condition after imparting of the wear resistant surface layer.

9. The method of claim 1 wherein preserving further comprises:

preserving a majority of the outer cylindrical surface in the as-formed condition after imparting of the wear resistant surface layer.

10. The method of claim 1 wherein preserving further comprises:

preserving a majority of both of the outer cylindrical surface and the inner cylindrical surface in the as-formed condition after imparting of the wear resistant surface layer.

11. The method of claim 1 further comprising:

cleaning the lash adjuster body after imparting; and polishing the lash adjuster body after imparting.

12. The method of claim 1, further comprising:

subsequent to imparting the wear resistant surface layer, removing the wear resistant surface layer at a select portion of the lash adjuster body; and crimping the select portion of the lash adjuster body to create a hook portion configured to retain a leak down and ball plunger of the lash adjuster assembly.

13. A lash adjuster body for use in a lash adjuster assembly, the lash adjuster body comprising:

an outer cylindrical surface; and an inner cylindrical surface having a leak down portion and a blind bore, wherein at least the leak down portion of the inner cylindrical surface includes a wear resistant outermost surface layer imparted with a sub-critical temperature process using ferritic nitrocarburizing (FNC) subsequent to annealing to relieve stresses and the leak down portion is preserved in an as-formed condition existing prior to the imparting of the wear resistant surface layer.

14. The lash adjuster body of claim 13 wherein the inner cylindrical surface further comprises a plunger shelf and a notch positioned between the leak down portion and the plunger shelf.

15. The lash adjuster body of claim 13, further comprising:

a hook portion formed on an area of the lash adjuster body without the wear resistant surface layer, the hook portion configured to retain a leak down and ball plunger of the lash adjuster assembly.

16. A lash adjuster assembly comprising:

a lash adjuster body having an outer cylindrical surface, an inner cylindrical surface with a leak down portion and a blind bore, wherein at least the leak down portion of the inner cylindrical surface includes a wear resistant outermost surface layer imparted with a sub-critical temperature process using ferritic nitrocarburizing (FNC) subsequent to annealing to relieve stresses and the leak down portion is preserved in an as-formed condition existing prior to the imparting of the wear resistant surface layer; and a leak down plunger slidably received in the inner cylindrical surface against the leak down portion.

17. The lash adjuster assembly of claim 16 wherein a majority of the outer cylindrical surface and a majority of the inner cylindrical surface include the wear resistant surface layer and the majorities of the outer and inner cylindrical surfaces are preserved in the as-formed condition existing prior to the imparting of the wear resistant surface layer.

18. The lash adjuster assembly of claim 16 wherein a majority of the inner cylindrical surface includes the wear resistant surface layer and a functional geometry of the majority of the inner cylindrical surface is maintained in the as-formed condition existing prior to the imparting of the wear resistant surface layer.

19. The lash adjuster body of claim 16 wherein the wear resistant surface layer is further defined as having a depth of less than forty microns.

20. The lash adjuster assembly of claim 16, further comprising:

a hook portion formed on an area of the lash adjuster body without the wear resistant surface layer, the hook portion configured to retain the leak down and ball plunger.

* * * * *